United States Patent [19]

Timblin

[11] 4,146,886

[45] Mar. 27, 1979

[54] FREEZER ALARM WITH EXTENDED LIFE

[76] Inventor: Stanley W. Timblin, #4 Forest Hill Ct., Greensboro, N.C. 27410

[21] Appl. No.: 799,499

[22] Filed: May 23, 1977

[51] Int. Cl.[2] ..... G08B 21/00

[52] U.S. Cl. ..... 340/585; 340/593

[58] Field of Search ..... 340/228 R, 227.1, 227 R, 340/283, 309.1, 63, 585, 584, 593, 595

[56] References Cited

U.S. PATENT DOCUMENTS

| | | | |
|---|---|---|---|
| 2,984,820 | 5/1961 | Kennell | 340/63 |
| 3,959,787 | 5/1976 | Messmann et al. | 340/227 R |
| 4,027,302 | 5/1977 | Healey et al. | 340/227.1 |

*Primary Examiner*—Glen R. Swann, III

[57] ABSTRACT

An alarm signal device sounded by a self-contained power source is activated responsive to a variance of temperature within a refrigerator or freezer beyond set limits. A timing circuit in the form of an integrated circuit causes the alarm to sound or flash intermittently for periods of extremely short duration compared to the relatively long periods between warning signals, thus extending the life of the alarm power source.

3 Claims, 1 Drawing Figure

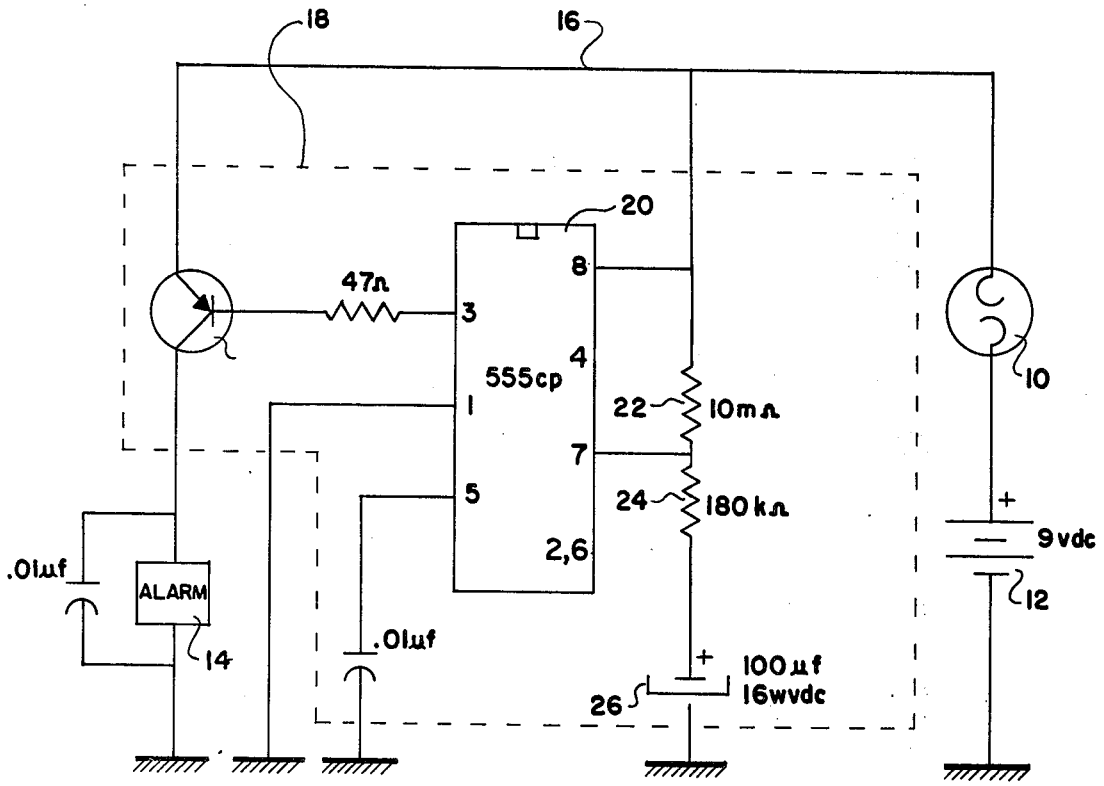
18
16
20
8
47Ω
3
4
555cp
1
22
10mΩ
7
5
24
180kΩ
2,6
.01μf
ALARM
14
.01μf
100μf
16wvdc
26
10
9vdc
12

FREEZER ALARM WITH EXTENDED LIFE

BACKGROUND OF THE INVENTION

While the advantages of freezing and refrigerating foods is apparent, problems can and do arise if the electrical power, usually in the form of house current, fails to such freezers and refrigerators, or if for some reason the temperature within the freezer or refrigerator chamber rises above a prescribed level tending to thaw or unchill food. This problem is acutely prevalent in commercial freezing cabinets which are unattended for hours at a time, or in a person's home when the occupants are gone and for some reason the temperature rises above prescribed limits.

It is known to provide alarm circuits for such refrigerator and freezer cabinets which will sound or flash when the temperature rises above prescribed limits. Of course it is also possible that the temperature may fall to too low a level due to a malfunction in the refrigerant cycle, which situation should also be monitored. However, such situations generally require a self-contained power source, such as a battery, because one of the most prevalent reasons for the temperature rise is the loss of conventional house current. When this occurs, according to known systems, an alarm buzzer, gong, or light is caused to continuously sound or signal until an attendant or the home owner comes to investigate the problem. While this may be quite satisfactory for instances in which the freezer or refrigerator is attended most or all of the time, such as in a home, there are many instances in which the freezer or refrigerator is left relatively unattended for hours or days at a time, in which case the self-contained power source fails or goes dead prior to the time anyone is on the scene to investigate. In such cases, when someone finally does come and the power source has failed there is no warning signal emitted. Even though the contents may still be frozen or salvagable, since no alarm is sounded, no investigation is made.

SUMMARY OF THE INVENTION

This invention, however, is directed to solving that problem with a unique alarm system and circuit which, in general, activates an alarm intermittently, only for short periods, such as for fifteen seconds every fifteen minutes. This way, however, the self-contained power source may be extended almost indefinitely or at least until someone is likely to become aware of the unattended freezer or refrigerator. Preferably the alarm system includes a thermostat or temperature controlled, primary switch which activates the alarm circuit responsive to a fluctuation in temperature in the enclosure beyond set limits. Once the electrical circuit is actuated a timing or control means in the form of an integrated circuit alternately charges or discharges a capacitor which, upon one of the aforementioned conditions triggers a transistor as a secondary switch to activate the alarm itself for a short period.

It is therefore an object of the present invention to provide an improved freezer alarm.

It is another object of the present invention to provide an improved alarm system for freezers and refrigerators in which the life of the self-contained power source which energizes the alarm is extended considerably longer than in systems known heretofore.

It is yet another object of the present invention to provide an alarm system for freezers of the type described in which the alarm mechanism is activated intermittently for periods of relatively short duration as compared to the inactive periods therebetween.

Other objects and a fuller understanding of the invention will become apparent from reading the following detailed description of a preferred embodiment in association with the accompanying drawing in which:

The FIGURE is an electrical schematic representative of the alarm system according to a preferred embodiment of the present invention.

DETAILED DESCRIPTION OF THE PREFERRED EMBODIMENT

Turning now to a discussion of the system according to the present invention, a thermostat 10 is placed within a refrigerated compartment (not shown) and so connected to an electrical circuit 16, containing a self-contained power source 12, that upon fluctuation of the temperature within the compartment outside of prescribed limits, a buzzer, gong, light, whistle, or other alarm or warning device 14 is activated. In general, the electrical circuit 16 connects the self-contained power source 12 and the alarm 14. The thermostat or temperature control switch or primary switching means 10 is positioned in the circuit containing the power source 12 and buzzer 14.

Also in the circuit between the power source 12 and buzzer 14 is a control or timing means 18 which is activated responsive to a closing of the primary switching means 10 and controls the operation of the alarm device 14 by intermittently triggering the buzzer for first groups of periods of relative short duration, alternating with second, longer periods therebetween. Preferably, the buzzer 14 is triggered for ten or fifteen seconds every ten or fifteen minutes.

More specifically, the timing means 18 includes an integrated circuit 20 having a plurality of terminals designated by the numbers 1–8, which operates a final switch or triggering transistor 28. Such an integrated circuit (commercially available under the designation of a No. 555 circuit) works very well in this situation, although other integrated circuits could be adapted to also function in the same manner. Two resistors 22, 24 are connected between appropriate pins of circuit 20 to vary the timing cycle. In the illustrated instance, the first resistor 22 is a ten million ohm, while resistor 24 is a 180,000 ohm resistor. The two resistors, when connected as shown, alternately charge and discharge the capacitor 26 therebelow. As long as the capacitor is charged, as when a current passes through the smaller resistor 22, a signal passes to transistor switch 28, the switch does not conduct and the buzzer does not sound. During shorter periods when the capacitor 26 discharges, as when the circuit is allowed through the larger resistor 24, no signal passes, and the transistor switches to make the circuit causing the buzzer to sound.

Preferably, transistor 28 is of the P-N-P type, which inverts and amplifies the signal. The transistor 28 acts as a final switch or triggering means which is triggered by the circuit as stated hereinabove.

In operation, as long as the temperature within the freezer or refrigerator is within the prescribed limits the thermostat 10 is open, and no current flows to the alarm circuit 16. When the temperature fluctuates to an extent outside the prescribed limits, the thermostat conducts current from the self-contained power source 12 and the alarm circuit 16 is activated. Initially, there will be a short period of delay before the buzzer first sounds due to the conventional operation of the type No. 555 integrated circuit 20. Then the buzzer will alternately be triggered for short periods of duration, followed by long periods of silence. Such an operation will extend the life of the power source considerably and provide the objects set forth hereinabove.

Although a preferred embodiment of the invention has been illustrated and described in detail hereinabove it is obvious that various modifications and changes might be made to the circuit without departing from the scope of the invention set forth in the claims below.

What is claimed is:

1. An alarm system for refrigerated food compartments such as freezers and refrigerators of the type normally operated from conventional house or building current, comprising:

(a) a self-contained electrical voltage source;

(b) an alarm means for emitting a warning signal responsive to the receipt of energy from said self-contained voltage source;

(c) an electrical circuit means connecting said self-contained electrical voltage source to said alarm means for selectively transmitting energy from said power source to said alarm means according to a prescribed intermittent pattern;

(d) a temperature controlled primary switching means in said electrical circuit including a sensing means within said compartment, said primary switching means activated responsive to a fluctuation beyond set limits of temperature within said food compartment to energize said electrical circuit; and (e) said electrical circuit further including a:

(i) timing means between said primary switching means and the alarm means for intermittently emitting a first signal for periods of relatively long duration alternating with a second type of signal for periods of relatively short duration;

(ii) a triggering means in the electrical circuit between said power source and said alarm means for triggering said alarm means responsive to said second types of signal;

(f) said alarm system continuing, after activation of said primary switching means, to signal an improper temperature condition until such time as said system is manually deactivated or said voltage source fails.

2. The alarm system according to claim 1 wherein said timing means comprises an integrated circuit and said triggering means comprises a transistor which passes a signal to the alarm means responsive to the emission of said second type of signal.

3. An alarm system for refrigerated food compartments such as freezers and refrigerators of the type normally operated from conventional house or building current, comprising:

(a) a self-contained source of electrical voltage;

(b) an alarm means for emitting a warning signal responsive to the receipt of electrical energy from said self-contained source;

(c) an electrical circuit means connecting said voltage source and said alarm means including:

(i) a primary switching means for activating said electrical circuit responsive to a temperature fluctuation in said food compartment beyond prescribed limits; and (ii) a control means responsive to the closing of said primary switching means for intermittently passing energy from said voltage source to said alarm means responsive to a preset timing pattern having first inactive periods of relatively long duration alternated with second activated periods of relatively short duration.

(d) said alarm system continuing, after activation of said primary switching means, to signal an improper temperature condition until such time as said system is manually deactivated or said voltage source fails.

* * * * *